US006650297B2

(12) United States Patent
Anderson et al.

(10) Patent No.: US 6,650,297 B2
(45) Date of Patent: Nov. 18, 2003

(54) LASER DRIVEN PLASMA ANTENNA UTILIZING LASER MODIFIED MAXWELLIAN RELAXATION

(75) Inventors: Theodore R. Anderson, Galway, NY (US); Robert J. Aiksnoras, Salem, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 8 days.

(21) Appl. No.: 10/120,214

(22) Filed: Apr. 10, 2002

(65) Prior Publication Data

US 2003/0193435 A1 Oct. 16, 2003

(51) Int. Cl.[7] ..... H01Q 1/26
(52) U.S. Cl. ..... 343/701; 333/99 PL
(58) Field of Search ..... 343/701, 793; 333/99 PL; H01Q 1/26

(56) References Cited

U.S. PATENT DOCUMENTS 6,087,992 A * 7/2000 Anderson ..... 343/701
6,087,993 A * 7/2000 Anderson et al. ..... 343/701
6,118,407 A * 9/2000 Anderson ..... 343/701

* cited by examiner

*Primary Examiner*—Hoanganh Le
(74) *Attorney, Agent, or Firm*—James M. Kasischke; Michael F. Oglo; Jean-Paul A. Nasser

(57) ABSTRACT

A laser driven plasma antenna system utilizes a laser having an output for emitting a laser beam that is directed toward and is reflected from the ionosphere so as to produce an ionized column of air extending between the laser and the ionosphere such that electromagnetic radiation is conducted through the ionized column of air as electrical current, and a pulsing circuit for pulsing the laser in accordance with a predetermined pulse rate that corresponds to a particular frequency of interest such that electromagnetic radiation having the particular frequency is conducted through the ionized column as electrical current having a frequency equal to the particular frequency.

5 Claims, 1 Drawing Sheet

LASER DRIVEN PLASMA ANTENNA UTILIZING LASER MODIFIED MAXWELLIAN RELAXATION

STATEMENT OF GOVERNMENT INTEREST

The invention described herein may be manufacture and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention generally relates to a laser driven plasma antenna.

(2) Description of the Prior Art

The particular structure and configuration of an antenna system depends upon the particular frequency range with which the antenna is to be used. For example, antennas for use in the VLF ("very low frequency"), ELF ("extremely low frequency") or ULF ("extremely low frequency") ranges are significantly different in structure in comparison to antennas used in the VHF ("very high frequency" or UHF ("ultra high frequency") ranges.

One typical prior art ELF antenna is the HED ("horizontal electric dipole") antenna. However, typical HED antennas are inefficient. Furthermore, HED antennas must be located where large regions of low ground conductivity exists. Another prior art ELF antenna is the VED ("vertical electric dipole") antenna. The VED antenna is generally more efficient than the HED, but is aerostat-supported unwieldy, and subject to "blowdown" which causes the antenna to assume the shape of a catenary.

What is needed is an antenna suitable for communications in the ULF, ELF and VLF ranges that eliminates the problems associated with conventional antennas that are used for such frequency ranges.

Therefore, it is an object of the present invention to provide an antenna system that addresses the foregoing problems.

Other objects and advantages of the present invention will be apparent to one of ordinary skill in the art in light of the ensuing description of the present invention.

SUMMARY OF THE INVENTION

In one aspect, the present invention is directed to a laser driven plasma antenna system. The antenna system comprises a laser that directs a laser beam toward the ionosphere so as to produce an ionized column of air, also referred to as "plasma column", that extends to the ionosphere. In one embodiment, the laser is a high powered laser. The laser drives electrons and ions upward by effecting the transfer of momentum from the photons to the electrons and ions. This transfer of momentum produces an upward current. Since the mass of the electrons is relatively insignificant in comparison to the ions, the electrons are the primary source of upward current. After an amount of time elapses, the electrons and the ions relax to equilibrium positions at different rates in a gravitational field. The relaxation of the ions and electrons is referred to as Maxwellian relaxation. The difference in relaxation rates of the electrons and ions produces a downward current. The laser is pulsed at a rate that corresponds to a frequency of interest. Thus, electromagnetic radiation having the frequency of interest is conducted through the ionized column of air as electrical current.

Several important features of the laser driven plasma antenna of the present invention are:

a) the laser produces the ionized column of air and the upward current simultaneously;

b) photon momentum and Maxwellian relaxations are used to produce current in a gravitational field; and c) the ionized column extends between the laser and the ionosphere.

In one embodiment, the laser driven plasma antenna system comprises a laser having an output for emitting a laser beam that is directed toward the ionosphere so as to produce an ionized column of air extending between the laser and the ionosphere such that electromagnetic radiation is conducted through the ionized column of air as electrical current, and a pulsing circuit for pulsing the laser in accordance with a predetermined pulse rate that corresponds to a particular frequency of interest such that electromagnetic radiation having the particular frequency is conducted through the ionized column as electrical current having a frequency equal to the particular frequency of interest.

In a related aspect, the present invention is directed to a method of transmitting or receiving electromagnetic radiation, comprising the steps of providing a laser having an output for emitting a laser beam, directing the laser so that the laser beam is directed toward the ionosphere so as to produce an ionized column of air extending between the laser and the ionosphere such that electromagnetic radiation is conducted through the ionized column of air as electrical current, and pulsing the laser in accordance predetermined pulse rate that corresponds to a particular frequency of interest such that electromagnetic radiation having the particular frequency is conducted through the ionized column as electrical current having a frequency equal to the particular frequency of interest.

BRIEF DESCRIPTION OF THE DRAWINGS

The features of the invention are believed to be novel and the elements characteristic of the invention are set forth with particularity in the appended claims. The figure is for illustration purposes only and is not drawn to scale. The invention itself, however, both as to organization and method of operation, may best be understood by reference to the detailed description which follows taken in conjunction with the accompanying drawing in which:

DESCRIPTION OF THE PREFERRED EMBODIMENT

Figure 1:
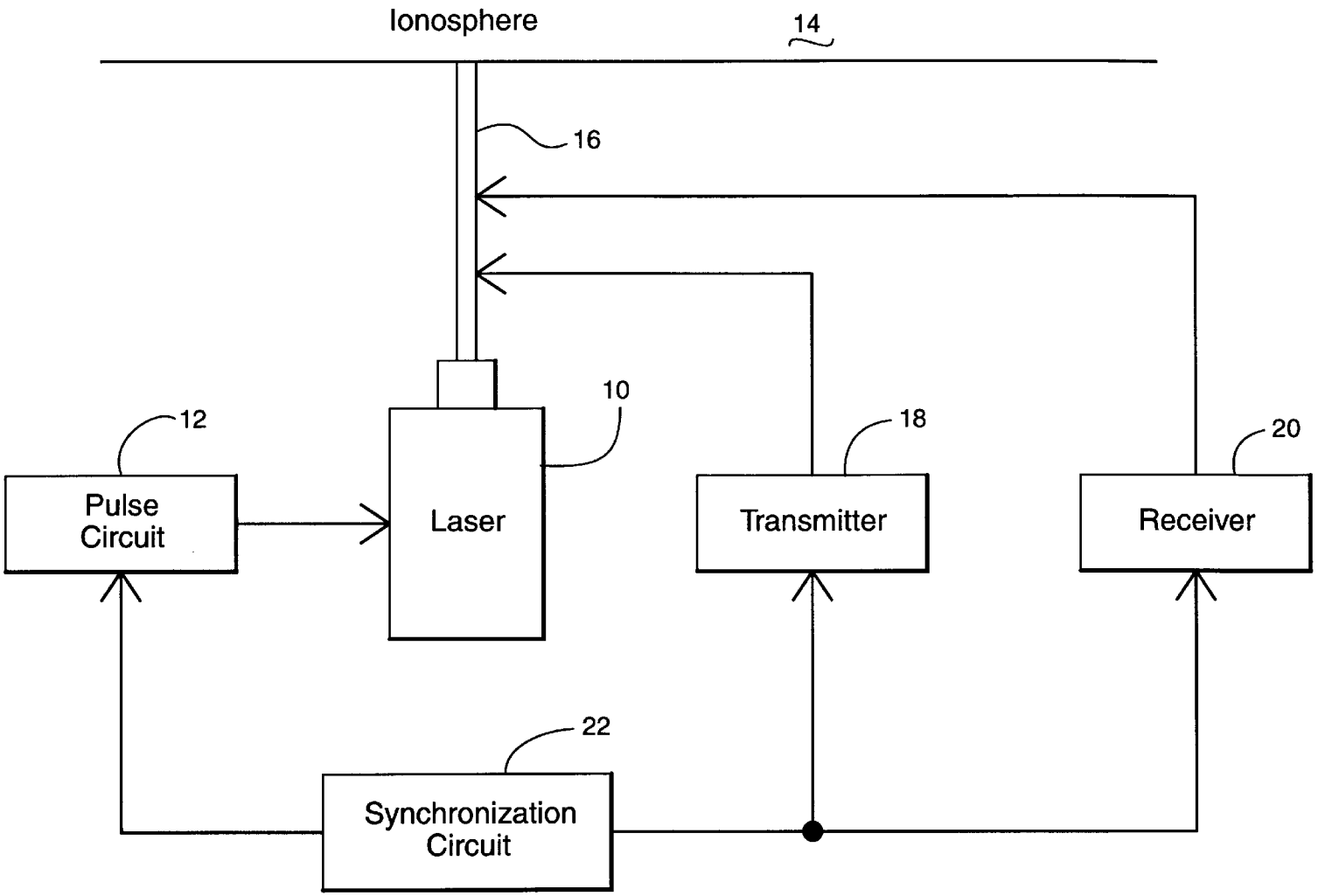
FIG. 1 is a block diagram of the laser driven plasma antenna of the present invention.

In describing the preferred embodiments of the present invention, reference will be made herein to FIG. 1 in which like numerals refer to like features of the invention.

Referring to FIG. 1, the laser driven antenna of the present invention generally comprises laser 10 and pulsing device 12. It is to be understood that the terms "laser" and "laser beam" as used hereinafter include not only presently known lasers as such, but also other light sources of high steradiancy that will excite ionization in a medium. Laser 10 produces a laser beam that is directed upward toward ionosphere 14 so as to create an ionized air column 16.

The degree of ionization depends on the electron temperature of the average energy of the free electrons, i.e.

plasma, at a particular altitude. The electron energy can be increased by absorption of incident electromagnetic radiation. This, in turn, increases the degree of ionization (i.e. number of free electrons and ions per unit volume). Ionized air column 16 functions as a current carrier. This feature is explained in detail in the ensuing description.

Pulsing device 12 pulses laser 10 in accordance with a pulse rate that corresponds to a frequency of interest. The purposes of this feature is discussed in the ensuing description. Pulsing laser 10 has several advantages. For example, a pulsed laser achieves greater instantaneous levels using practical apparatuses and amounts of input energy, and therefore, the effective length of the ionized column 16 can be significantly increased for a given laser. Furthermore, as time elapses after the ionized column of air has been established, it tends to lose its straight-line configuration and become generally serpentine and unstable. Therefore, the periodic extinguishing of the ionized column 16 in a pulsed system is beneficial since it allows such excessively unstable ionization to dissipate so that a new, straight and highly defined ionized column of air can be re-established.

Each photon of the laser beam outputted by laser 10 has momentum and exchanges that momentum with solid matter. Laser 10 drives the ions or electrons in a particular direction so as to cause inelastic collisions between the photons and the ions or electrons. The transfer of momentum from the photons to the electrons and ions in this manner produces an upward current (i.e. in the upward direction) in the plasma. Laser 10 effects creation of the aforementioned current over one-half the period of the frequency of interest. Due to the relatively insignificant mass of the electrons compared to the ions, the electrons are the primary source of upward current. After the upward current is produced, the ions and electrons rapidly relax to their respective Maxwell-Boltzman distributions. Normally, the time in which this relaxation occurs would exceed a period of the ELF of interest. However, it has been found that laser 10 reduces the relaxation time to about one-half of a period of the ELF of interest by transferring the appropriate amount of momentum from the photons to the ions and electrons. The electrons and ions relax to the equilibrium positions at different rates in a gravitational field. This difference in relaxation rates produces a downward current.

In order to transmit or receive signals at a particular frequency using ionized air column 16, pulsing device 12 pulses laser 10 in accordance with a predetermined pulse rate that corresponds to the particular frequency at which signals are to be transmitted and received. Thus, electromagnetic radiation having the particular frequency is conducted through ionized column 16 as electrical current having a frequency equal to the particular frequency or interest.

Referring to FIG. 1, the antenna system of the present invention may be used as part of a laser driven communication system that utilizes transmitter 18, receiver 20 and synchronization circuit 22. Transmitter 18 and receiver 20 are configured to operate in a particular frequency range, e.g. ULF, ELF, VLF, etc. Synchronization circuit 22 outputs control signals to pulsing circuit 12, transmitter 18, and receiver 20. Synchronization circuit 22 ensures that pulsing circuit 12 is pulsing laser 10 at the frequency of interest prior to coupling the signal outputted by transmitter 18 into ionized air column 16 and coupling signals from ionized air column 16 into receiver 20. Thus, the signals outputted by transmitter 18 are coupled into ionized air column 16 only after pulsing device 12 has started pulsing laser 10. Similarly, synchronization circuit 22 ensures that receiver 20 does not commence signal detection and processing until pulsing device 12 has started pulsing laser 10. Such a configuration eliminates the possibility of losing signal information carried by the signal outputted by transmitter 18 or the signals received by ionized air column 14. In one embodiment, synchronization circuit 22 comprises a trigger control circuit. It is to be understood that signal coupling devices well known in the art are used to couple signals into and out from ionized air column 16.

In another embodiment, a computer (not shown) is used to control laser 10, pulsing device 12, transmitter 18, receiver 20 and synchronization circuit 22. In such an embodiment, the computer is programmed with an appropriate software program to enable the components to function in accordance with the present invention.

The ionized column of air 16 has height on the order of the VED ELF antenna, with or without corona. Thus, the vertical length (or height) can be 12,500 feet, as for the VED ELF antenna, and 5.2 kilometers as for the corona-mode VED ELF antenna. If suitable lasers are used, the vertical length of ionized column 16 can have a vertical length between about 30 and 70 kilometers which more than sufficient to reach the ionosphere.

In one embodiment, laser 10 is a high powered $CO_2$ laser. In an alternate embodiment, a plurality of lasers are used to create ionized column 16.

Although the ensuing description has been in terms of the laser driven plasma antenna system of the present invention being used for communications in the ELF range, it is to be understood that the laser driven plasma antenna system of the present invention can be used to effect communication in frequency ranges other than the ELF range, e.g. ULF, VLF, LF, etc.

The present invention can be embodied in the form of computer processor readable program code embodied in a computer processor usable medium, such as floppy diskettes, CD-ROMs, hard drives, or any other computer-readable storage medium, wherein, when the computer program code is loaded into and executed by a computer, the computer becomes an integral part of an apparatus or system for practicing the invention.

The laser driven plasma antenna system has many advantages and benefits. Specifically, the laser driven plasma antenna system of the present invention:

a) is transportable;

b) can be quickly set up and disassembled;

c) is significantly more efficient than prior art antenna systems used in the ELF range;

d) utilizes an ionized column of air that has zero radar cross section; and e) can be realized with readily available components.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A method for generating a laser driven plasma antenna, comprising:

providing a laser for emitting a laser beam;

directing the laser so that the laser beam is directed toward the ionosphere so as to produce an ionized column of air extending between the laser and the ionosphere such that electromagnetic radiation is conducted through the ionized column of air as electrical current; and pulsing the laser in accordance predetermined pulse rate that corresponds to a particular frequency of interest such that electromagnetic radiation having the particular frequency is conducted through the ionized column as electrical current having a frequency equal to the particular frequency of interest.

2. The method according to claim 1 further comprising varying the rate at which the laser is pulsed.

3. A laser driven plasma antenna system, comprising:

a laser having an output for emitting a laser beam that is directed toward and is reflected from the ionosphere so as to produce an ionized column of air extending between the laser and the ionosphere such that electromagnetic radiation is conducted through the ionized column of air as electrical current; and a pulsing circuit for pulsing the laser in accordance with a predetermined pulse rate that corresponds to a particular frequency of interest such that electromagnetic radiation having the particular frequency is conducted through the ionized column as electrical current having a frequency equal to the particular frequency.

4. The laser driven plasma antenna system according to claim 3 further comprising means for varying the rate at which the laser is pulsed.

5. The laser driven plasma antenna system according to claim 3 wherein the laser is a high-powered $CO_2$ laser.

* * * * *